US010731798B2

(12) United States Patent
Jiang et al.

(10) Patent No.: US 10,731,798 B2
(45) Date of Patent: Aug. 4, 2020

(54) FILAMENT LIGHTING APPARATUS AND MANUFACTURING METHOD THEREOF

(71) Applicant: Leedarson Lighting Co., Ltd., Zhangzhou, Fujian (CN)

(72) Inventors: Hongkui Jiang, Fujian (CN); Chenjun Wu, Fujian (CN); Yanzeng Gao, Fujian (CN)

(73) Assignee: Leedarson Lighting Co., Ltd., Zhangzhou, Fujian (CN)

( * ) Notice: Subject to any disclaimer, the term of this patent is extended or adjusted under 35 U.S.C. 154(b) by 0 days.

(21) Appl. No.: 15/860,661

(22) Filed: Jan. 3, 2018

(65) Prior Publication Data

US 2019/0093831 A1 Mar. 28, 2019

(30) Foreign Application Priority Data

Sep. 28, 2017 (CN) ..... 2017 1 0901128

(51) Int. Cl.

| | |
|---|---|
| ***F21K 9/237*** | (2016.01) |
| ***F21K 9/232*** | (2016.01) |
| ***F21V 29/70*** | (2015.01) |
| ***F21K 9/90*** | (2016.01) |
| ***F21V 23/00*** | (2015.01) |
| *F21K 9/238* | (2016.01) |
| *F21Y 115/10* | (2016.01) |

(52) U.S. Cl.

CPC ..... *F21K 9/237* (2016.08); *F21K 9/232* (2016.08); *F21K 9/90* (2013.01); *F21V 23/009* (2013.01); *F21V 29/70* (2015.01); *F21K 9/238* (2016.08); *F21Y 2115/10* (2016.08)

(58) Field of Classification Search

CPC . F21K 9/237; F21K 9/90; F21K 9/232; F21K 9/238; F21V 29/70

See application file for complete search history.

(56) References Cited

U.S. PATENT DOCUMENTS

| | | | | |
|---|---|---|---|---|
| 9,995,474 | B2 * | 6/2018 | Jiang | F21V 29/70 |
| 10,234,079 | B1 * | 3/2019 | Spehalski | F21K 9/235 |
| 10,240,724 | B2 * | 3/2019 | Jiang | F21K 9/237 |
| 2013/0058080 | A1 * | 3/2013 | Ge | F21V 3/00 362/231 |
| 2018/0347766 | A1 * | 12/2018 | Choi | F21K 9/237 |

* cited by examiner

*Primary Examiner* — Kevin Quarterman
(74) *Attorney, Agent, or Firm* — Chun-Ming Shih; Lanway IPR Services

(57) ABSTRACT

A filament lighting apparatus includes a base, a pillar, multiple lamp strips, a fixed metal strip, a driving circuit and a lamp cap. The lower end of the pillar connects to the base. Each lamp strip has an upper end point and a lower end point. The upper end point of the lamp strip is electrically connected to the fixed metal strip. The fixed metal strip is disposed about an upper end of the pillar and the fixed metal strip doesn't directly contact the pillar. The lower end of at least two of the lamp strips are electrically connected to the driving circuit. The lamp cap accommodates the driving circuit and supports the base. The present invention discloses a method of manufacturing the filament lighting apparatus.

16 Claims, 11 Drawing Sheets

FILAMENT LIGHTING APPARATUS AND MANUFACTURING METHOD THEREOF

FIELD OF THE INVENTION

The present invention is related to a filament lighting apparatus and a manufacturing method thereof, and more particularly related to a filament lighting apparatus for lamps and a manufacturing method thereof.

BACKGROUND OF THE INVENTION

A Lamp is a very important apparatus for human civilization life. With development of technology, multiple lamps are designed and manufactured to meet multiple requirements.

With the progress of light Emitting Diode (LED) technology and decline in cost, light emitting diode manufacturing lamps increasingly popular to people's daily lives. Most of white LEDs are currently produced through coating a layer of yellow phosphor on a blue LED (near-UV, wavelengths 450 nm to 470 nm). The yellow phosphor usually obtained by mixing cerium doped with cerium Aluminum garnet (Ce3+:YAG) crystals, and grind the mixture, mix them in a dense adhesive. When the LED chip is blue, part of the blue light will be very efficient conversion of the crystal into a broad spectrum (spectral center is about 580 nm) mainly yellow light. As the yellow light may stimulate red and green light in the naked eye, and then mixed with the blue LED, making it look like white light, and the color is often called "moonlight white." The method of making white LEDs was developed by Nichia Corporation and used in 1996 to produce white LEDs. To adjust the color of light yellow light, other rare earth metal terbium or gadolinium may be used to replace cerium (Ce) doped with Ce3+:YAG, or even to replace part or all of aluminum in YAG. Based on the characteristics of the spectrum, red and green objects in the LED irradiation may not look like the broad spectrum of light when the light so clear. In addition, due to the variation of production conditions, the color temperature of the finished product of the LED is not uniform, differing from warm yellow to cold blue, so the production process may be distinguished by outcome characteristics.

Another method of making white LED is a bit like a fluorescent lamp, emitting near ultraviolet LED may be coated with two kinds of phosphor mixture, one is red and blue light europium, the other is green, doped with copper and aluminum of zinc sulfide (ZnS). Because the UV may make the adhesive in the epoxy resin cracking deterioration, production is more difficult, and life is shorter. Compared with the first method, it is less efficient and produces more heat (because former Stokes shift is larger), but the advantage is better spectral characteristics, producing the better look light, and because the UV light LED power is high, so the efficiency is relatively low compared to the first method, but the brightness is similar.

The latest method of making white LEDs is no longer used phosphors. The new approach is to grow the epitaxial layer of zinc selenide on zinc selenide (ZnSe) substrates. The active area emits the blue light and the substrate emits yellow when connecting the power, and then mixing together becomes white light.

There are some different technical problems have to be solved in the different light emitting diode lamps, including heat dissipation, light efficiency and light emission direction. In addition, if it may further reduce the cost of manufacturing may also help to increase the popularity of the light emitting diode lamps in human society.

SUMMARY OF THE INVENTION

According to the first embodiment of the present invention, providing a filament lighting apparatus including a base, a pillar, multiple lamp strips, at least one fixed metal strip, a driving circuit and a lamp cap. The lower end of the pillar is connected to the base. The pillars may be one or more elongated structures, such as glass pillar, metal strip pillar, pillars of various material mixes, and the like. The base and the pillars may be made of the same glass materials, or may be made of different materials. The base is connected to the pillar in a manner through fusing together after heating or in-mold assembly.

Each of the multiple lamp strips has an upper end point and a lower end point. The lamp strip may be an elongated structure. The lamp strip is composed of multiple light emitting diode modules or other light emitting elements to provide illumination functions. Multiple light emitting diode modules connect to each other in parallel or in series. It is possible to set the corresponding circuit on the lamp strip to meet the requirements. The conductive terminals are set on two sides of the lamp strip to transmit the current to the multiple light emitting diode modules. The conductive terminals are set at the upper and lower end points, for example, by a conductive sheet or a conductive strip.

At least one fixed metal strip electrically connects to the upper end of the lamp strip. The fixed metal strip is set around the upper end of the pillar, and the fixed metal strip is not directly connected to the pillar. It is not necessary that the fixed metal strip mentioned here has a specific strip shape and be made by 100% metal. The material of the fixed metal strip contains a specific proportion of metal to make electrical connections between the lamp strips. In other words, the upper end of the lamp strip may be indirectly connected to the upper end of another lamp strip by means of a fixed metal strip.

In addition, the fixed metal strip may be multiple identical, similar or different fixed metal strips. In other words, the one or more metal strips may constitute multiple different structures. The following example may be used to illustrate several possible implementations.

In addition, the fixed metal strip surrounds the upper end of the pillar and may have a surrounding portion hundred percent around the upper end of the post. However, the surround here does not need to be hundred percent closed, as long as the lamp strip may be shaken when the fixed metal strip is driven may have the opportunity to touch the pillar, and thus avoid more than the predetermined range of shaking may be considered to belong to the definition of the surround here.

In addition, the fixed metal strip connected to the upper end of the lamp strip does not come into direct contact with the pillar, meaning that the fixed metal strip remains at a certain distance from the post.

In order to provide a source of electricity, at least two of the lower end points of the lamp strip are electrically connected to the drive circuit to receive power supply. The lamp cap may accommodate the drive circuit and support the base, and may be made in different shapes and configurations, such as a standard Edison lamp cap or multiple different shapes, and the structure for connection with the outside may be regarded as a lamp cap.

As described above, in some embodiments, the fixed metal strip keeps a distance from the pillar. The fixed metal strip touches the upper end of the pillar when the lamp is shaken to a predetermined distance to prevent the lamp strip from shaking beyond the predetermined distance. In practically, the fixed metal strip has a ring structure, and extends out of the bracket welding a number of lamp strip in the ring structure. The ring structure maintains a distance for 0.5 cm from the pillars. The ring structure is driven when the light is shaken by the handling. Because the distance between the ring structure and the pillar is only 0.5 cm, once the ring structure shaking more than 0.5 cm may touch the pillar and prevent further displacement of the lamp. In the condition of lamp strip having a certain flexibility may ensure the lamp strip structure to maintain a certain stability.

Of course, as mentioned above, the fixed metal strips do not have to be hundred percent closed around the pillars. As long as with some closed parts, when the lamp strip drives the fixed metal bar to shake and make contact parts touch the pillar, and stop further shaking may fall within the scope of the invention to be protected.

For example, there may be two or more fixed metal strips in practical. The two or more fixed metal strips may have two or more openings relative to each other around the upper end of the pillar. In other words, the one or more fixed metal bars as long as make a certain degree of encirclement to the pillars, it is referred to the around form here.

The fixed metal strips may be made of nickel metal or iron-nickel alloy or other materials, and the fixed metal strips have a certain degree of elasticity. The fixed metal strip may also include an insulating material that allows the fixed metal strip to retain multiple isolated electrical connections to match the different lamp strips in parallel or in series in other implementations.

In another embodiment, the magnet may be embedded at the upper end of the pillar, and a certain magnetic property may be added to the fixed metal strip. Through the magnetic phase suction or repulsion to enhance the stability of the overall structure of lamp strip.

In addition, the upper end of the multiple lamp strips forms the first polygon, and the lower end constitutes the second polygon. It may make the circumference of the first polygon and the circumference of the second polygon greater than ½ in the design process. In some embodiments, the circumference ratio of the circumference of the first polygon to the second polygon is greater than or equal to ¾.

The configuration may achieve uniform illumination, and reduce the spot with enhanced heat dissipation.

For example, if there are four lamp strips, the upper end of the lamp strips may form an upper quadrilateral, and the lower end of the lamp strip may form a lower quadrilateral. The circumference of the upper quadrilateral may be greater than ½ of the circumference of the lower quadrilateral, or further greater than or equal to ¾.

In addition, the endpoints of the polygons do not have to be all in one plane. Also, the first polygon and the second polygon may be similar, identical, but not necessarily identical or identical. In order to reduce the spot, a misalignment may be maintained between the first polygon and the second polygon. For example, the first polygon is similar to the second polygon, but both have different relative angles with respect to the axis of the pillar. The angle may be set between 15 degrees and 60 degrees.

In addition, the filament lighting apparatus may further include a lamp cover in practice, such as a transparent or translucent or misty bulb. The lampshade and the base form an enclosed space and may arrange heat dissipation gas.

The pillars may be made by glass material, metallic material or other mixed material. The wire may be set in the pillar or the surface of the pillar, etc. to provide multiple light spot connection possibilities.

The upper end of the lamp strip may be connected to the fixed metal strip by welding or other means. At the time of manufacture, the fixed metal strips may be pre-embedded or otherwise secured to the pillars and are disconnected from the pillar after connecting the lamp strips. In other words, the pillars may hold a portion of the same material as the fixed metal strip.

According to another embodiment of the present invention, providing a method of manufacturing a filament lighting including:

A pillar is set on the base. At least one fixed metal strip is set at the upper end of the pillar. The upper end of the multiple lamp strips is welded to the fixed metal strip. Connecting the lower end of the multiple lamp strips to the base. Disengaging the connection between the fixed metal strips of the pillar such that the fixed metal strip surrounds the upper end of the pillar.

For example, the base and pillars are made by pouring glass into the mold. In the production process, the structural part of the fixed metal strip may be embedded in the pillar. Then, the light bar is welded to the fixed metal strip. After the connection of the fixed metal strip to the pillar is carried out by cutting or hot-melting.

DETAILED DESCRIPTION

Figure 1:
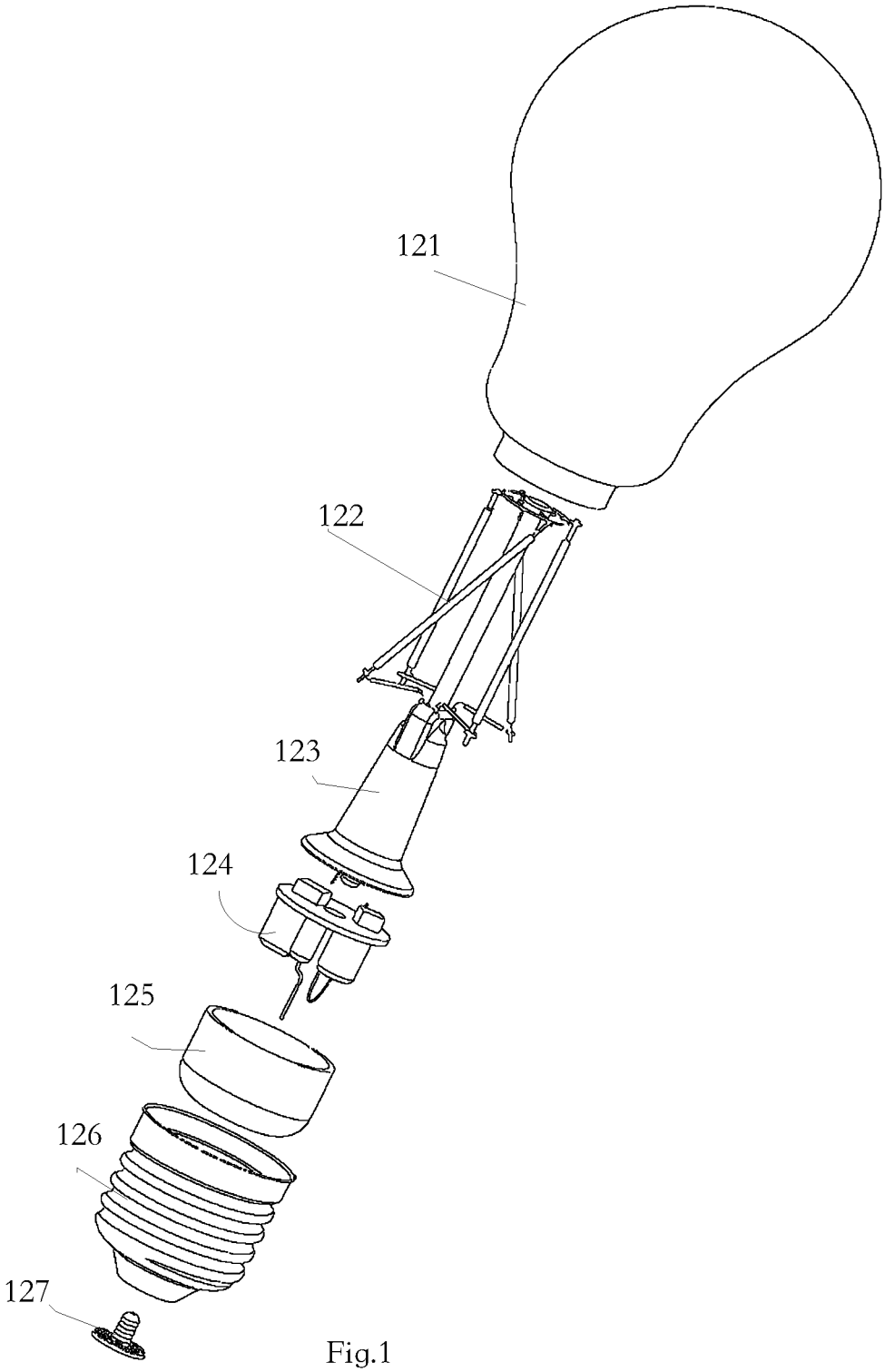
FIG. 1 illustrates an exploded view of the various elements of a filament lighting apparatus.

Please refer to FIG. 1, FIG. 1 illustrates an exploded view of the various elements of a filament lighting apparatus. The filament lighting apparatus has a bulb shell 121 as a lamp shell, a lamp strip module 122, a base 123, a driving circuit 124, an inner liner 125 as an insulating cup, a lamp cap 126, and a lamp nail 127.

In the example, the bulb shell 121 and the base 123 are made of glass, and forming a containing space. The bulb shell 121 may be a transparent material, a matte surface or multiple colors. The lamp strip module 122 and the heat dissipation gas are placed in the containing space. The lamp cap 126 may be multiple standard specifications of the Edison lamp cap or other structural connector for directing external power input to the driving circuit 124. The driving circuit 124 may convert an external power supply to provide a current suitable for the voltage characteristics to the lamp strip module 122.

The filament light may be placed in multiple different fixtures. In this embodiment, the lamp strip module 122 may have features such as lamp strips, pillar, fixed metal strips, and the like. Multiple implementation examples are illustrated by a series of illustrations. Of course, the examples are not intended to limit the scope of the invention.

Figure 2:
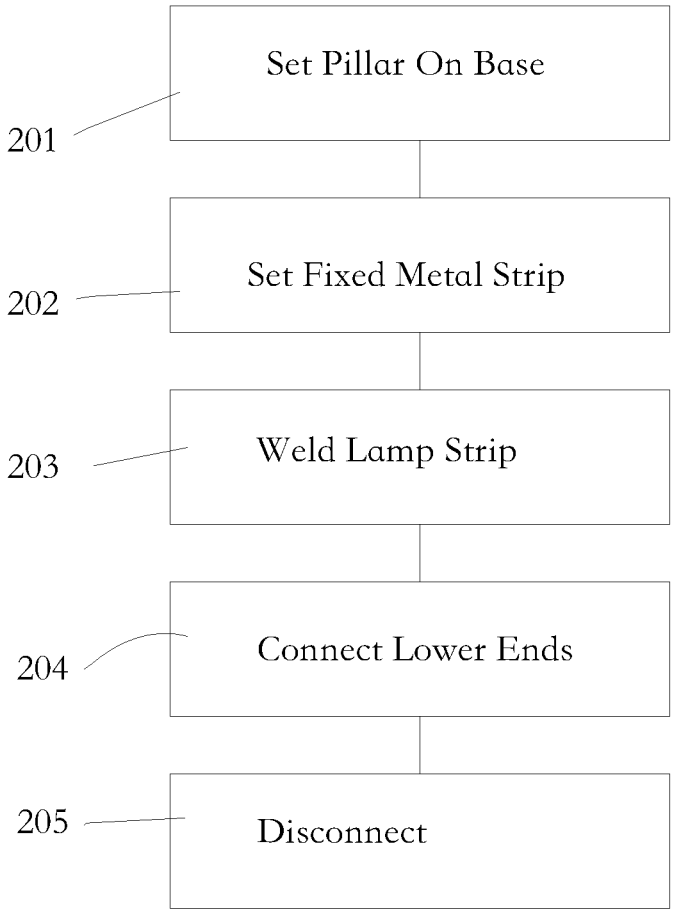
FIG. 2 illustrates a flowchart embodiment of a manufacturing method of a filament lighting apparatus.

Before starting to explain the embodiment of the detailed lamp strip module 122, please refer to FIG. 2. FIG. 2 illustrates a flowchart embodiment of a manufacturing method of a filament lighting apparatus as shown in FIG. 1.

First, a pillar is set on a base (step 201). The base may be similar to the base shown in FIG. 1, in which a pillar may be set. In one embodiment, the base and the pillar may each be made of glass, or may be made of different materials. The base and the pillar may be in the same process, with the same mold, may also be two components, and then by heat welding or other means to be fixed together.

In addition, at least one fixed metal strip is set at the upper end of the pillar (step 202). The following may illustrate the shape of several different fixed metal strips.

Then, the upper end of the multiple lamp strips is welded to the fixed metal strip (step 203). Connecting the lower end of the plurality of light bars to the base (step 204). After the lamp strip is connected to the fixed metal strip, the connection between the fixed metal strip and the pillar may be disconnected (step 205). But even if disengaged, the structure of the fixed metal strip is set so that the fixed metal strip surrounds the upper end of the pillar.

In other words, in the production method, the fixed metal strip was originally connected with the upper end of the pillar, but be broken in the production process. Of course, the method does not necessarily have to be tied to all the embodiments implemented by the present invention. Some embodiments of filament lightings do not have to be made in the way.

In particular, an embodiment of a filament lighting apparatus according to the present invention is characterized by including a base, a pillar, multiple lamp strips, at least one fixed metal strip, a driving circuit and a lamp cap. For example, the structure described in FIG. 1.

Figure 3:
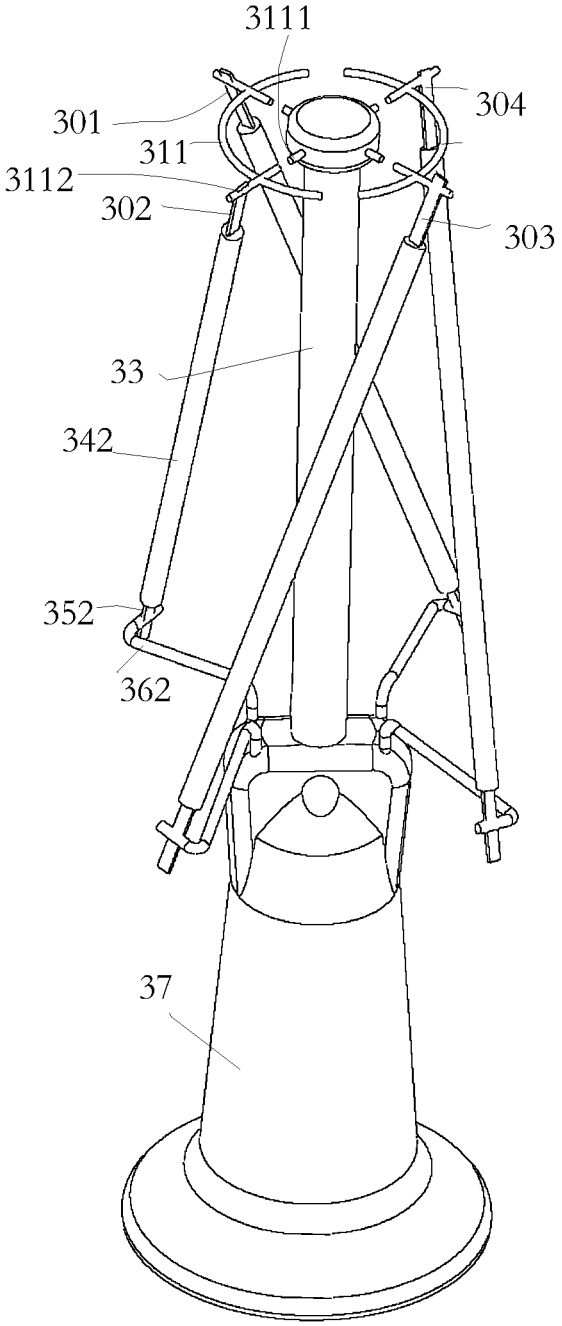
FIG. 3 illustrates a schematic of lamp strips arrangement.

Next, refer to FIG. 3. FIG. 3 illustrates a structure of a lamp strip module and a base, and also illustrates other related examples.

In FIG. 3, the lower end of the pillar 33 is connected to the base 37. The pillar 33 may be one or more elongated structures, such as glass pillar, metal strip pillar, pillars of various material mixes, and the like. The base 37 may be of the same material as the pillar 33, or may be different material. The base is connected to the pillar in a manner may be fused together after heating or together through the same mold.

Each lamp strip of multiple lamp strips has an upper end point and a lower end point. For example, the lamp strip 342 has an upper end 302 and a lower end 352. In the embodiment, there are four lamp strips, so there are four corresponding upper points 301, 302, 303, 304 of the corresponding lamp strip. In the example, the fixed metal strip 311 has two semicircular encircling structures, and multiple branches extending from the semicircular surround structure, the upper ends of the strip being welded to the branches. For example, the upper end 302 of the light bar 342 is soldered to the branch 3112. As shown in the flow chart of FIG. 2, the original fixed metal strip is connected to the pillar. In the example, the fixed metal strip is partially embedded in the pillar 33 during the manufacturing process, and after the lamp strip is fixed to the fixed metal strip, the fixed metal strip is disconnected from the post. Thus, in FIG. 3, may see the fixed metal strip has a partial residual structure remaining at the upper end of the post 33, such as the participating structure 3111 in the figure.

In the example, the lower end 352 of the lamp strip 33 is connected to the base 37 through a metal strip 362. The metal strip 362 and the fixed metal strip 311 have a certain structural support force, so that the lamp bars may be kept in a predetermined expanded shape.

The lamp strip may be an elongated structure in which multiple light emitting diode modules or other light emitting elements are attached to provide illumination functions. Multiple light emitting diode modules are connected in parallel or in series. If necessary, you may place the corresponding circuit on the lamp strip. A conductive terminal is set on both sides of the light bar to direct current to the light emitting diode modules. The conductive terminals are set at the upper and lower end points, for example, by a conductive sheet or a conductive strip.

As described above, the upper end of the lamp strip is electrically connected to the fixed metal strip. The fixed metal strip being disposed about an upper end of the pillar and the fixed metal strip not directly contacting the pillar. For example, in the example of FIG. 3, the fixed metal strip 311 surrounds the pillar 33 by two semicircular structures.

It is not necessary that the fixed metal strip mentioned here has a specific strip shape and be made by 100% metal. The metal strips mentioned here have a certain proportion of metal and may be used to provide electrical connections between lamp strips. In other words, the upper end of the lamp strip may be indirectly connected to the upper end of another lamp strip by means of a fixed metal strip.

In addition, the fixed metal strip may contain multiple identical, similar or different fixed metal strips. In other words, the one or more metal strips may constitute a variety of different structures. The following examples may illustrate several possible implementations in conjunction with a number of illustrations.

Figure 4:
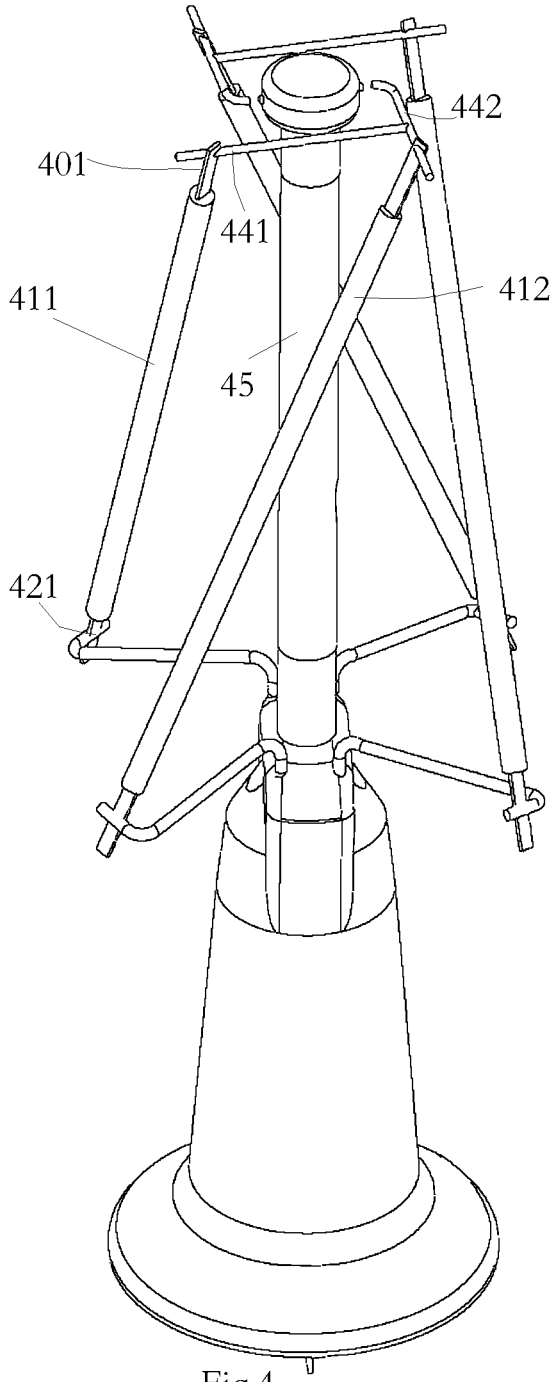
FIG. 4 illustrates another embodiment of a lamp strip arrangement.

Please refer to FIG. 4, FIG. 4 illustrates another design of lamp strip, fixed metal strip and pillars.

In FIG. 4, the fixed metal strip contains two T-shaped structures 421, respectively connecting two lamp strips. The two T-shaped structures 421 are partially embedded in the post 45 and are disconnected during the manufacturing process. For example, one of the T-shaped structures 421 has two branches 442, 441 for connecting the upper end points of the two light bars 411, 412, such as the upper end point 401. Even after the break, the fixed metal strip remains the posture around the post 45.

Figure 5:
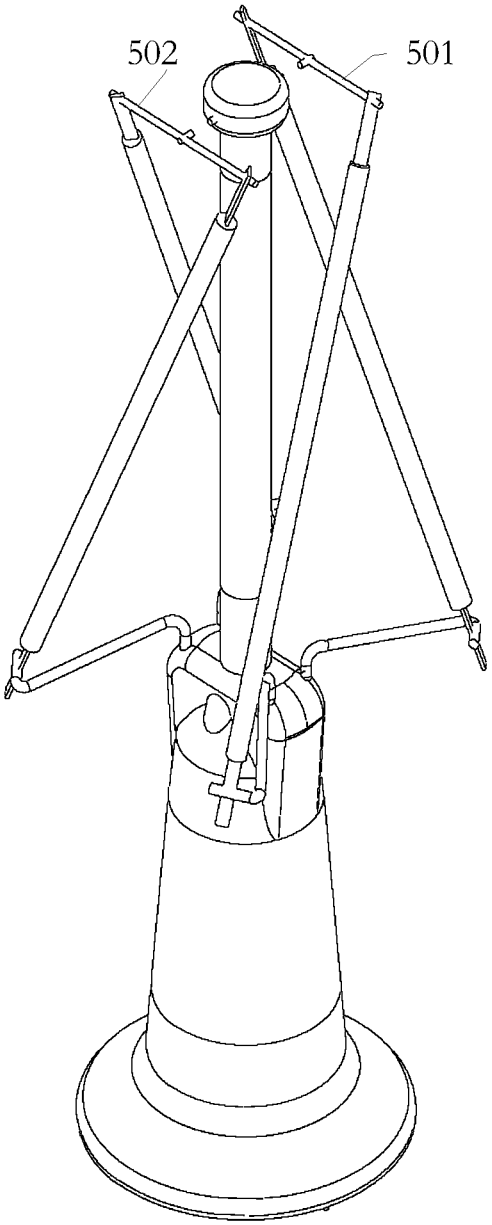
FIG. 5 illustrates another embodiment of a lamp strip arrangement.

Please refer to FIG. 5, FIG. 5 illustrates another design of lamp strip, fixed metal strip and pillars.

In FIG. 5, the structure of the fixed metal strip contains two T-shaped rod 501, 502, and the two T-shaped rod structures 501, 502 are disconnected from the pillar during the manufacturing process. But even so, the fixed metal strip still surrounds the pillar after disconnection. The two fixed metal strips ensure multiple lamp strips remain in a certain form.

Figure 6:
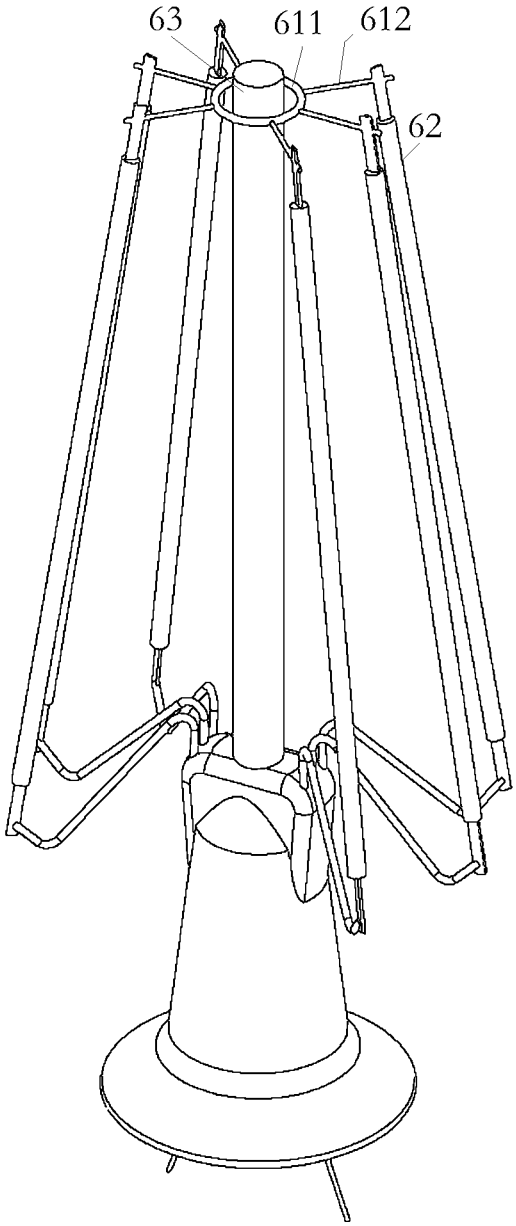
FIG. 6 illustrates another embodiment of a lamp strip arrangement.

Please refer to FIG. 6, FIG. 6 illustrates another design of lamp strip, fixed metal strip and pillars.

In FIG. 6, the fixed metal strip has a ring structure 611 and multiple branches, such as branch 612. The upper end of the light bar 62 is connected to the branches so that the lamp strips 62 remain in a certain posture. The circular structure 611 remains separated from the post 63. In the example, the fixed metal strips are not connected to the pillars from the beginning. In other words, this example does not need to be manufactured through the method shown in FIG. 2.

Figure 7:
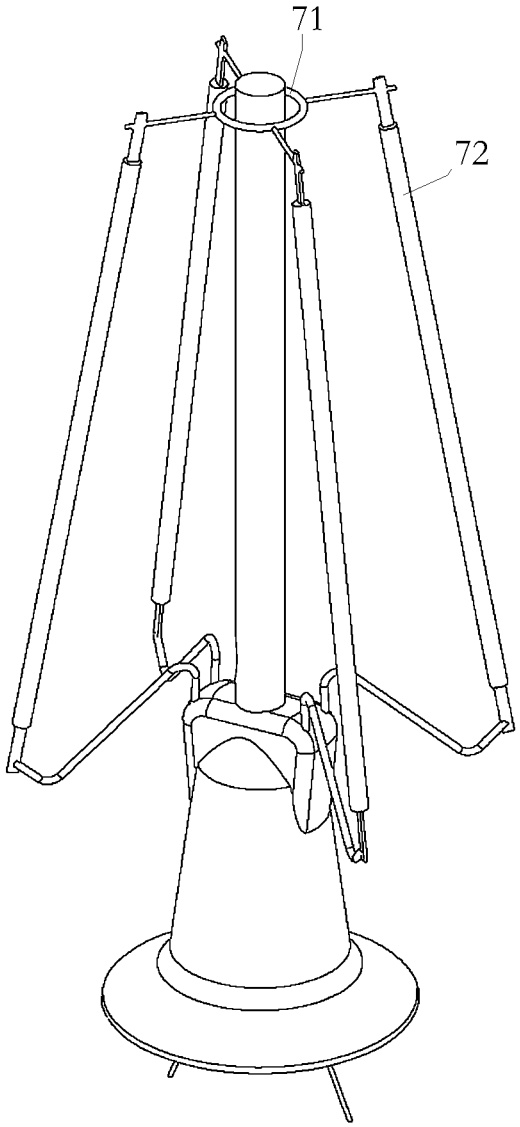
FIG. 7 illustrates another embodiment of a lamp strip arrangement.

Please refer to FIG. 7, FIG. 7 illustrates another design of lamp strip, fixed metal strip and pillars.

Contrary to six lamp strips of FIG. 6, there are four lamp strips 72 in the embodiment of FIG. 7. The lamp strips 72 pass through the fixed metal strips 71 and surround the pillars.

Figure 8:
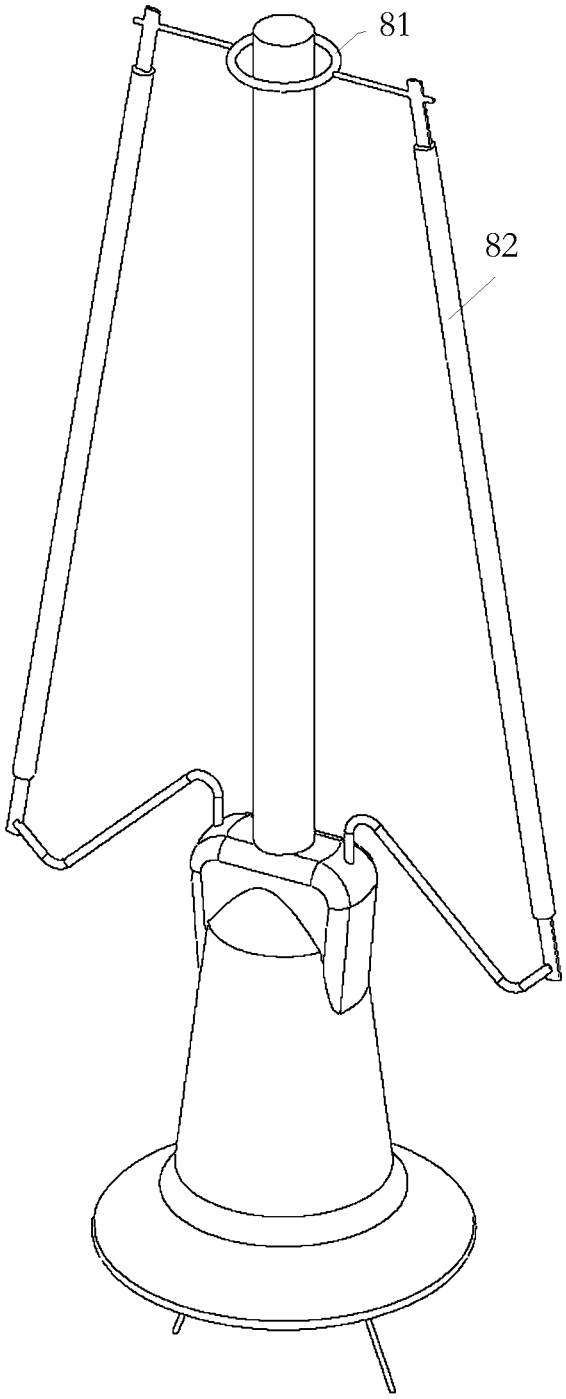
FIG. 8 illustrates another embodiment of a lamp strip arrangement.

Please refer to FIG. 8, FIG. 8 illustrates another design of lamp strip, fixed metal strip and pillars.

Contrary to four lamp strips of FIG. 7, there are two lamp strips 82 in the embodiment of FIG. 7. The lamp strips 82 pass through the fixed metal strips 81 and surround the pillars.

In other words, the lamp strip may have a different number. The fixed metal strips may have different structures. The way the fixed metal strips surround the pillar may also be in multiple different design ways.

In addition, it is mentioned here that the fixed metal strip surrounds the upper end of the pillar and may have a surrounding portion hundred percent around the upper end of the post. However, the surround here does not need to be hundred percent closed, as long as the lamp strip may be shaken when the fixed metal strip is driven may have the opportunity to touch the pillar, and thus avoid more than the predetermined range of shaking, it may be considered to belong to the definition of the surround here.

In addition, the fixed metal strip connected to the upper end of the lamp strip does not come into direct contact with the pillar, meaning that the fixed metal strip remains at a certain distance from the post.

In order to provide a source of electricity, at least two of the lower end points of the lamp strips are electrically connected to the driving circuit to receive power supply. The lamp cap may accommodate the driving circuit and support the base, and may be made in different shapes and configurations, such as a standard Edison lamp cap or a variety of different shapes, and the structure for connection with the outside may be regarded as a lamp cap.

As described above, in some embodiments, the fixed metal strip keeps a distance from the pillar. The fixed metal strip touches the upper end of the pillar when the lamp is shaken to a predetermined distance to prevent the lamp strip from shaking beyond the predetermined distance. In practically, the fixed metal strip has a ring structure, and extends out of the bracket welding a number of lamp strip in the ring structure. The ring structure maintains a distance for 0.5 cm from the pillars. The ring structure is driven when the light is shaken by the handling. Because the distance between the ring structure and the pillar is only 0.5 cm, once the ring structure shaking more than 0.5 cm may touch the pillar and prevent further displacement of the lamp. In the condition of lamp strip having a certain flexibility may ensure the lamp strip structure to maintain a certain stability.

Of course, as mentioned above, the fixed metal strips do not have to be hundred percent closed around the pillars. As long as with some closed parts, when the lamp strip drives the fixed metal bar to shake and make contact parts touch the pillar, and stop further shaking may fall within the scope of the invention to be protected.

For example, there may be two or more fixed metal strips in practical. The two or more fixed metal strips may have two or more openings relative to each other around the upper end of the pillar. In other words, the one or more fixed metal bars as long as make a certain degree of encirclement to the pillars, it is referred to the around form here.

The fixed metal strips may be made of nickel metal or iron-nickel alloy or other materials and have a certain degree of elasticity. In other implementations. The fixed metal strip may also include an insulating material that allows the fixed metal strip to retain multiple isolated electrical connections to match the different lamp strips in parallel or in series.

In another embodiment, the magnet may be embedded at the upper end of the pillar, and a certain magnetic property may be added to the fixed metal strip. Through the magnetic phase suction or repulsion to enhance the stability of the overall structure of lamp strip.

In addition, the upper end of the multiple lamp strips forms the first polygon, and the lower end constitutes the second polygon. At the time of design, may make the circumference of the first polygon and the circumference of the second polygon greater than ½. In some embodiments, the circumference ratio of the circumference of the first polygon to the second polygon is greater than or equal to ¾.

Figure 9A:
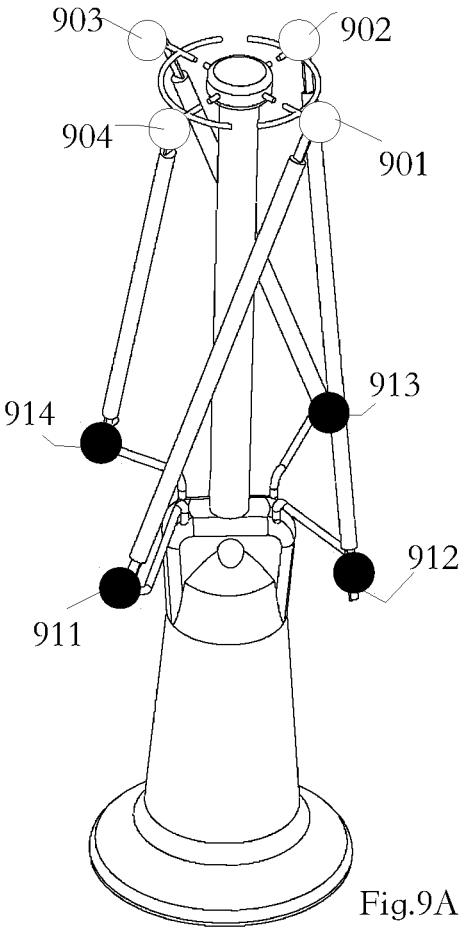
FIG. 9A and FIG. 9B illustrates the angle of the lamp strips arrangement.
Figure 9B:
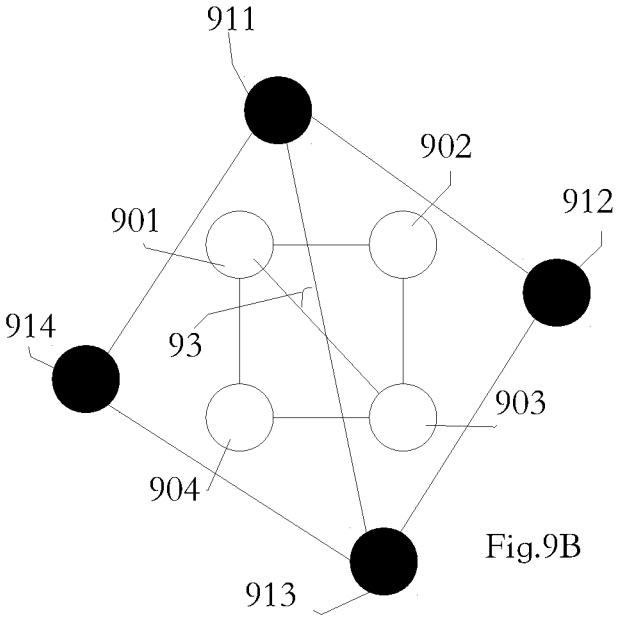

Please refer to FIG. 9A and FIG. 9B, the two figures illustrate the polygonal relationship of the upper and lower end points of the light bar.

In FIG. 9A, the four lamp strips have four upper end points 901, 902, 903, 904 and four lower end points 911, 912, 913, 914. FIG. 9B illustrates a vertical view of four upper end points 901, 902, 903, 904 and four lower end points 911, 912, 913, 914.

First, the four upper ends 901, 902, 903, 904 constitute a first quadrilateral. The four lower end points 911, 912, 913, 914 constitute a second quadrilateral. As described above, the upper end point may be adjusted by fixing the metal strip, and the lower bar may also be adjusted by the associated structure with the fixed position so that the lamp may be unfolded in a predetermined manner. At the time of fabrication, the ratio of the circumference of the first quadrilateral to the circumference of the second quadrilateral may be made larger than ½. In some embodiments, the circumference of the circumference of the first quadrilateral and the second quadrilateral is greater than or equal to ¾. In the example, the first quadrilateral is similar to the second quadrilateral and has a misalignment 93 between the two. Through this setting may make the whole luminous uniform, reduce the spot with enhanced heat effect.

In the above embodiment, the fixed metal strip is separated from the pillar, but the fixed metal strip may remain connected to the post in other embodiments.

Figure 10A:
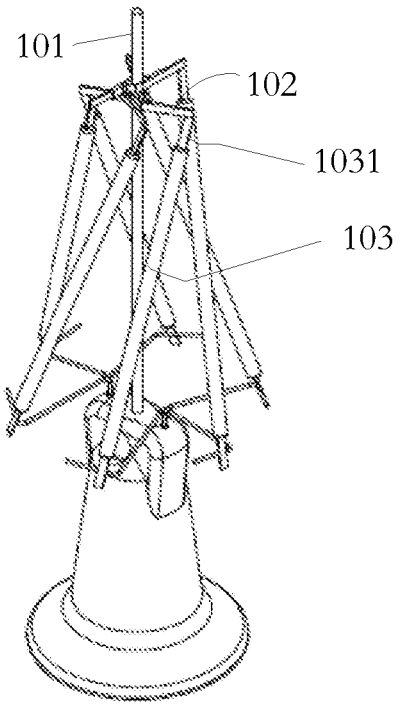
FIG. 10A and FIG. 10B illustrates another embodiment.

For example, referring to FIG. 10A. The upper end point 1031 of the multiple lamp strips 103 is first connected to a fixed metal strip 102, which is further fixed to the post 101 to form a lamp strip module.

Figure 10B:
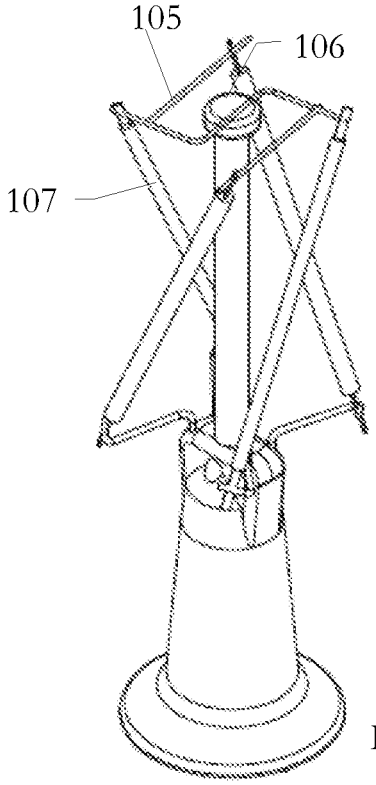

For another example, referring to FIG. 10B. The upper end of the lamp strip 107 is connected to the fixed metal strip 105, and then the fixed metal strip is further fixedly connected to the post 106.

In addition, the endpoints of the polygons do not have to be all in one plane. Also, the first polygon and the second polygon may be similar, identical, but not necessarily identical or identical. In order to reduce the spot, a misalignment may be maintained between the first polygon and the second polygon. For example, the first polygon is similar to the second polygon, but both have different relative angles with respect to the axis of the pillar. The angle may be set between 15 degrees and 60 degrees.

Figure 11:
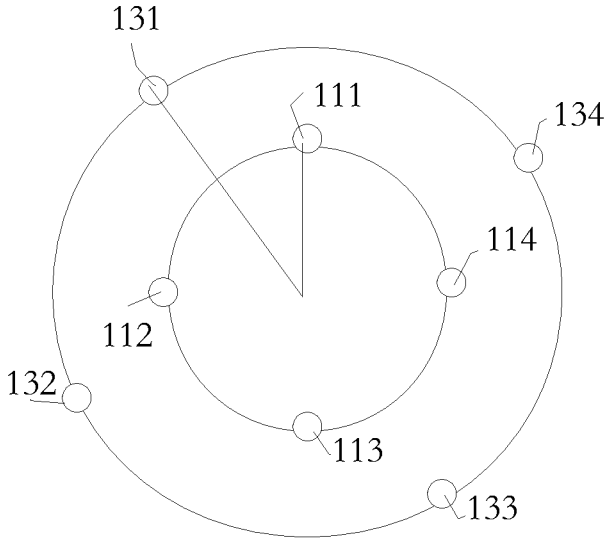
FIG. 11 illustrates the angle of the lamp strips arrangement.

FIG. 11 illustrates the expansion and misalignment of the upper and lower end points of the lamp strip in another way.

The upper ends 111, 112, 113, 114 of the four lamp strips and the lower ends 131, 132, 133, 134 of the four lamp strips are shown in FIG. 11. The four upper end points 111, 112,

113, 114 may be considered to fall within the first round, and the four lower ends 131, 132, 133, 134 may be considered to fall within the second round. The ratio of the circumference of the first circle to the circumference of the second circle is greater than ½. In some embodiments, the ratio of the circumference of the first circle to the circumference of the second circle is greater than or equal to ¾. In addition, the upper end point 111 and the lower end point 131 are two end points of a lamp strip having a misalignment 110 from each other.

In addition, the filament lighting apparatus may further include a lamp cover in practice, such as a transparent or translucent or misty bulb. The lampshade and the base form an enclosed space and may arrange heat dissipation gas.

The pillars may be made by glass material, metallic material or other mixed material. The wire may be set in the pillar or the surface of the pillar, etc. to provide multiple light spot connection possibilities.

The upper end of the lamp strip may be connected to the fixed metal strip by welding or other means. At the time of manufacture, the fixed metal strips may be pre-embedded or otherwise secured to the pillars and are disconnected from the pillar after connecting the lamp strips. In other words, the pillars may hold a portion of the same material as the fixed metal strip.

According to another embodiment of the present invention to provide a method of manufacturing a filament lighting apparatus including:

A pillar is set on the base. At least one fixed metal strip is set at the upper end of the pillar. The upper end of the multiple lamp strips is welded to the fixed metal strip. Connecting the lower end of the multiple lamp strips to the base. Disengaging the connection between the fixed metal strips of the pillar such that the fixed metal strip surrounds the upper end of the pillar.

For example, the base and pillar are made by pouring glass into the mold. In the production process, the structural part of the fixed metal strip may be embedded in the pillar. Then, the light bar is welded to the fixed metal strip. After the connection of the fixed metal strip to the pillar is carried out by cutting or hot-melting.

In addition to the embodiments mentioned above, the present invention may have other possibilities of implementation. As long as the changes are still subject to the application of the concept of the present invention, it may still be considered as belonging to the present invention. In addition to the above described embodiments, various modifications may be made, and as long as with the spirit of the same invention, the various designs may be made by the skilled in the art are susceptible to the present invention range.

The invention claimed is:

1. A filament lighting apparatus, comprising:

a base;

a pillar, wherein the lower end of the pillar is connected with the base;

a plurality of lamp strips, wherein each lamp strip has an upper end point and a lower end point;

at least one fixed metal strip, wherein the upper end point of the lamp strip is electrically connected to the fixed metal strip, the fixed metal strip is disposed about an upper end of the pillar and the fixed metal strip does not directly contact the pillar;

a driving circuit, wherein the lower end of at least two of the lamp strips are electrically connected to the driving circuit; and a lamp cap, wherein the lamp cap accommodates the driving circuit and supports the base.

2. The filament lighting apparatus of claim 1, wherein the fixed metal strip keeps a distance from the pillar, and touches the upper end of the pillar when the lamp is shaken to a predetermined distance to prevent the lamp strip from shaking beyond the predetermined distance.

3. The filament lighting apparatus of claim 1, wherein the fixed metal strip has a closed part, and the closed part of the metal strip is surrounded on the top end of the pillar.

4. The filament lighting apparatus of claim 1, further comprising more than two fixed metal strips, the more than two fixed metal strips with more than two openings when being surrounded on the top end of the pillar.

5. The filament lighting apparatus of claim 1, wherein upper ends of the multiple lamp strips form an upper polygon, and lower ends of the multiple lamp strips form a lower polygon, and a circumference ratio of the upper polygon to the lower polygon is greater than ½.

6. The filament lighting apparatus of claim 5, wherein upper ends of the multiple lamp strips form an upper polygon, and lower ends of the multiple lamp strips form a lower polygon, and a circumference ratio of the upper polygon to the lower polygon is greater than or equal to ¾.

7. The filament lighting apparatus of claim 5, wherein the upper polygon and the lower polygon are similar and have a misalignment.

8. The filament lighting apparatus of claim 1, wherein the lamp strip has multiple strip structures including light emitting diode modules.

9. The filament lighting apparatus of claim 1, further comprising a lamp shell, the lamp shell and the base forming a closed space, and heating dissipation gas being placed in the closed space.

10. The filament lighting apparatus of claim 1, wherein the fixed metal strip comprises nickel metal.

11. The filament lighting apparatus of claim 1, wherein the fixed metal strip comprises non-insulating materials and metal materials.

12. The filament lighting apparatus of claim 1, wherein the pillar is made of glass.

13. The filament lighting apparatus of claim 1, wherein the upper end of the lamp strip and the fixed metal strip are fixed by welding.

14. The filament lighting apparatus of claim 1, wherein the plurality of lamp strips are connected in series by means of the fixed metal strips.

15. The filament lighting apparatus of claim 1, wherein the plurality of lamp strips form a plurality of parallel lamp strip connection relations.

16. The filament lighting apparatus of claim 1, wherein the upper end of the pillar originally has a plurality of metal portions connected to the fixed metal strip but the metal portions are later removed.

* * * * *